US005890609A

United States Patent [19]

Shankland

[11] Patent Number: 5,890,609

[45] Date of Patent: Apr. 6, 1999

[54] TAMPER INDICATING CLOSURE SYSTEM

[75] Inventor: William J. Shankland, Newburgh, Ind.

[73] Assignee: Rexam Closures, Inc., Evansville, Ind.

[21] Appl. No.: 976,535

[22] Filed: Nov. 21, 1997

Related U.S. Application Data

[63] Continuation-in-part of Ser. No. 717,303, Sep. 20, 1996, Pat. No. 5,722,547.

[51] Int. Cl.[6] ..... B65D 5/74

[52] U.S. Cl. ..... 215/230; 215/901; 215/329; 229/125.04

[58] Field of Search ..... 215/230, 901, 215/250, 258, 329; 220/214, 288, 258; 229/125.01, 125.04, 125.14, 125.15, 102

[56] References Cited

U.S. PATENT DOCUMENTS

| | | | |
|---|---|---|---|
| 5,597,082 | 1/1997 | Luch et al. | 229/125.15 X |
| 5,735,426 | 4/1998 | Babcock et al. | 229/125.15 X |
| 5,738,231 | 4/1998 | Montgomery | 215/230 X |
| 5,765,747 | 6/1998 | Lawson | 229/125.04 X |

FOREIGN PATENT DOCUMENTS

| | | | |
|---|---|---|---|
| 712444 | 6/1965 | Canada | 215/258 |
| 435279 | 7/1991 | European Pat. Off. | 229/125.04 |

*Primary Examiner*—Stephen K. Cronin
*Assistant Examiner*—Nathan Newhouse
*Attorney, Agent, or Firm*—Gifford, Krass, Groh, Sprinkle, Anderson & Citkowski, P.C.

[57] ABSTRACT

Tamper indicating closure and container assembly which prior opening of the assembly is indicated by exposing projections formed integrally with the closure with such projections remaining concealed in the originally closed position of the assembly. The tamper indicating features are associated with a pouring spout on a gable-top container.

9 Claims, 2 Drawing Sheets

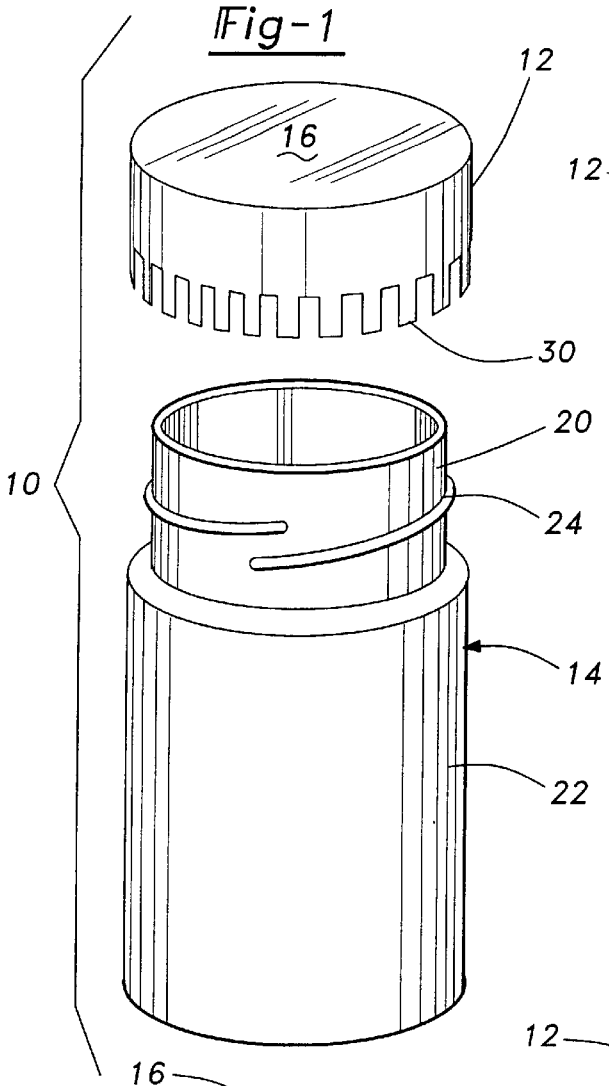
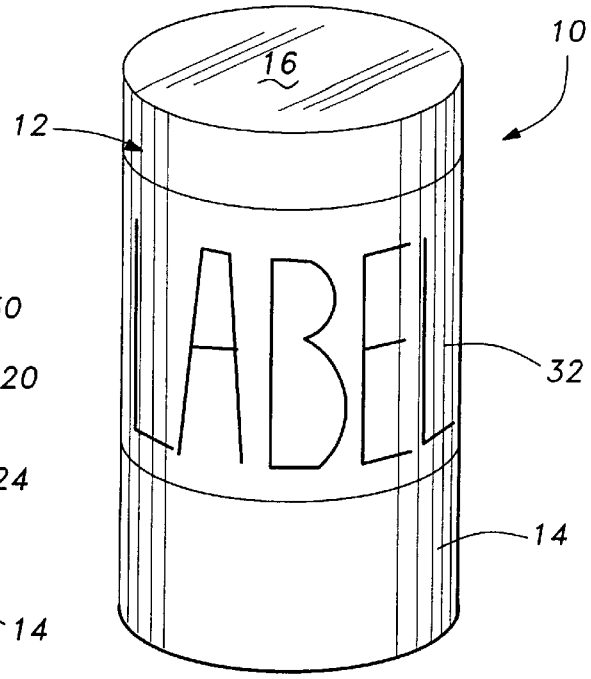
Fig-2
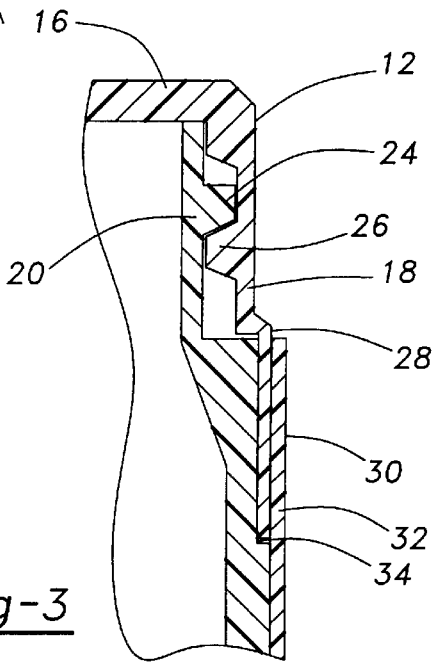
Fig-3
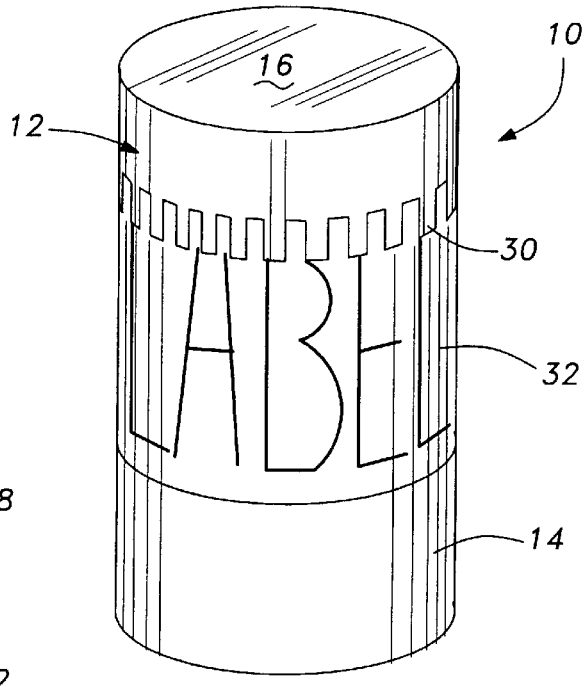
Fig-4

TAMPER INDICATING CLOSURE SYSTEM

This is a continuation-in-part application of Ser. No. 08/717,303 filed Sep. 20, 1996 now U.S. Pat. Ser. No. 5,722,547.

This invention relates to tamper indicating closure and container assemblies or packages.

Many tamper indicating closure and container assemblies of the prior art typically rely on destruction of a part of the assembly, to indicate prior opening. Some arrangements utilize a tear band which must be broken and once removed, prior opening is indicated. Still other tamper indicating arrangements require separation of parts such as a tamper indicating ring attached to the skirt of a closure by a line of weakening or webs which break upon removal of the closure for the first time leaving the broken and separated ring to indicate tampering. Such arrangements require careful design and manufacture to insure that opening can be accomplished with a uniform and low opening force. Also, such arrangements can create problems with respect to the disposal of the tear band or the tamper indicating ring once the closure has been opened.

In still other forms of tamper indicating packages, tamper indicating portions are initially concealed and are revealed after initial opening and during all subsequent opening and closing operations. In such arrangements however, the tamper indicating portions are initially concealed by components which are not a permanent portion of the package. Such components can be removed and replaced to defeat the tamper indicating features.

SUMMARY OF THE INVENTION

The present invention contemplates the utilization of existing features of a closure and container. For example, most packages incorporating a closure and container incorporate a label identifying the contents and displaying advertising. In one embodiment of the invention the addition of projections to an existing closure is all that is required with the projections positioned so that they are concealed by the label when it is in its normal position and are displayed in full view once the package has been opened to indicate prior opening. In another embodiment of the invention relating to gable-top folding cartons, all that is required is the addition of fingers to the closure which are concealed in their originally closed position by components of the fitment forming the pouring spout of the gabled container.

In each of the embodiments of the present invention, the components remain intact and prior opening is made apparent by a change in position of components which form a permanent part of the container.

It is an object of the invention to provide a closure container package in which tamper indicating projections extend from the closure for concealment by label or existing wall of the container until after the closure is removed from its closed position for the first time to reveal tamper indicating or prior opening.

It is another object of the invention to provide a tamper indicating closure and container assembly in which the tamper indicating feature is permanently incorporated in the closure and in the initially and originally closed condition is concealed by existing features of the container such as the label on a cylindrical container or walls of a gable-top container.

The purposes of the invention are attained by a construction in which projections are added to extend from the closure and in which the projections are concealed in the originally closed condition of the assembly by a permanent portion of the package such as a label in one embodiment of the invention, and by the walls of the gable-top of a container in another embodiment of the invention. Upon removal of the closure from the container for the first time, the projections are removed from their position of concealment and upon replacement of the closure, the projections remain exposed and in view to indicate prior opening.

BRIEF DESCRIPTION OF THE DRAWINGS

FIG. 1 is a perspective view of a closure and container embodying the invention prior to closing and before a label has been attached;

FIG. 2 is a view of a closed container which has never been opened;

FIG. 3 is a cross-sectional view of a portion of the closed container and closure seen in FIG. 2;

FIG. 4 is a perspective view of a closure on the container after it has been opened for the first time and re-closed to indicate prior opening;

DETAILED DESCRIPTION

Figure 5:
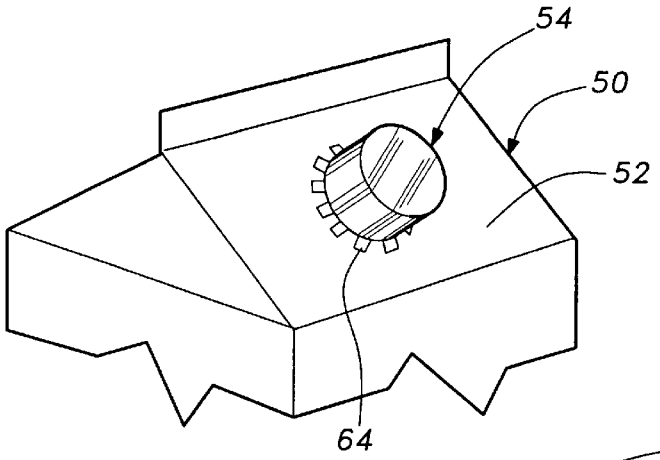
FIG. 5 is a perspective view of a gable-top container with a fitment showing another embodiment of the invention after the closure has once been removed.

Referring to the drawings, and particularly to FIGS. 1 through 3, a first embodiment of the invention is incorporated in a package or assembly designated generally at 10 and incorporating a closure 12 and a container 14.

The closure has a disc shaped top 16 and a cylindrical or annular skirt 18 extending from the top 16. The container 14 has a neck 20 which merges with a body portion 22. The neck 20 is provided with external threads 24 which are complementary to internal threads 26 formed on the interior surface of skirt 18 of the closure 12.

The lower edge of the skirt 18 forms a lip 28 from which one or more projections 30 extend axially of the closure 12. In a preferred embodiment of the invention, the projections 30 are in the form of axially extending fingers uniformly spaced circumferentially of the annular lip 28.

After the container 14 has been filled with its intended contents, the closure 12 can be placed on the container and threaded into position so that the fingers 30 overlap the upper outer surface of the body 22 with the fingers 30 extending substantially parallel to the axis of the package made up of the closure 12 and container 14. After filling of the container 14 and closing it with the closure 16, a label 32 can be applied to the container body 22 so that the label overlaps and conceals the fingers 30. For that purpose, the label 32 is without adhesive in that portion which overlaps the fingers 30. The remaining portion of the label 30 extending below the lower end of the fingers 30 is provided with adhesive which maintains the label 32 permanently attached to the container 14. In that position, the upper edge of the label 30 acts with the wall of the container 14 to form. a recess 34 which receives the fingers 30. At this point, the container and closure assembly 10 will appear as seen in FIG. 2 with indicia on the label 32 clearly visible in full. Upon removal of the closure 12 from the container 14, the fingers 30 will slide out of the recess 34 they are fully visible, as seen in FIG. 1. Upon re-closing the assembly by replacing the closure 12 on the container 14, the fingers 30, which are relatively thin and flexible, will not be able to reenter the recess 34 and will be forced to the outside of the label 32 so that in the re-closed position of the assembly 10, the closure 12 will appear as seen in FIG. 4 with the fingers 30 overlapping the label 32 and partially obscuring any indicia that may be on the label to give visual indication that there has been prior opening of the assembly 10.

Figure 7:
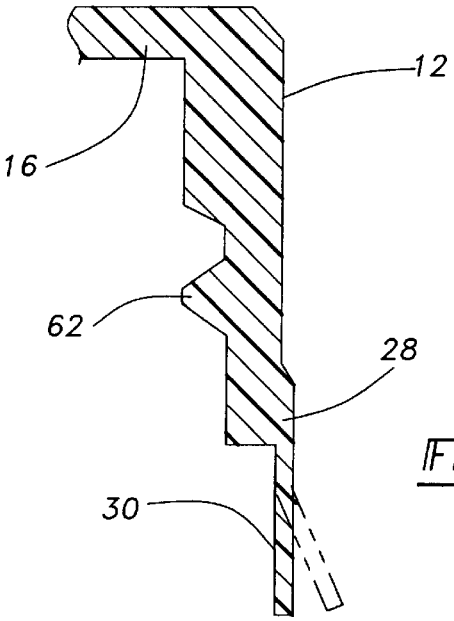
FIG. 7 is a partial sectional view of the closure seen in FIG. 2 with the fingers in their as-molded condition illustrating a variation in the embodiment shown in FIGS. 1–4.

Re-entry of the fingers 30 into the recess 34 is precluded because of the flexibility of the fingers 30 and the dimension of annular recess 34 which resists entry of the fingers 30. Although a plurality of fingers 30 is shown in the drawings, it will be understood that the projection 30 can be in the form of a continuous circumferential web. The re-entry of the projections 30, whether in the form of a web or multiple fingers, can be further enhanced by molding the projection 30 so that it extends at a slight angle to the axis of the closure 12 or preferably radially, outwardly and downwardly, as best seen in FIG. 7. After the label 32 is applied it will press the projection 30 into a parallel position with the neck of the container. Upon removal of the closure 12, the projection 30 will tend to return to its as-molded condition which would extend radially beyond the outer surface of the label 32 to insure that the projection 30 is guided outwardly of the label 32 upon re-closing of the container closure assembly 10.

Even with very careful manipulation it is not possible to position the fingers 30 so that they will reenter the recess 34. Any attempt to reposition the projections or fingers 30, to conceal them behind the label will be resisted and will result in damage to the upper edge of the label and will continue to indicate prior opening.

Figure 6:
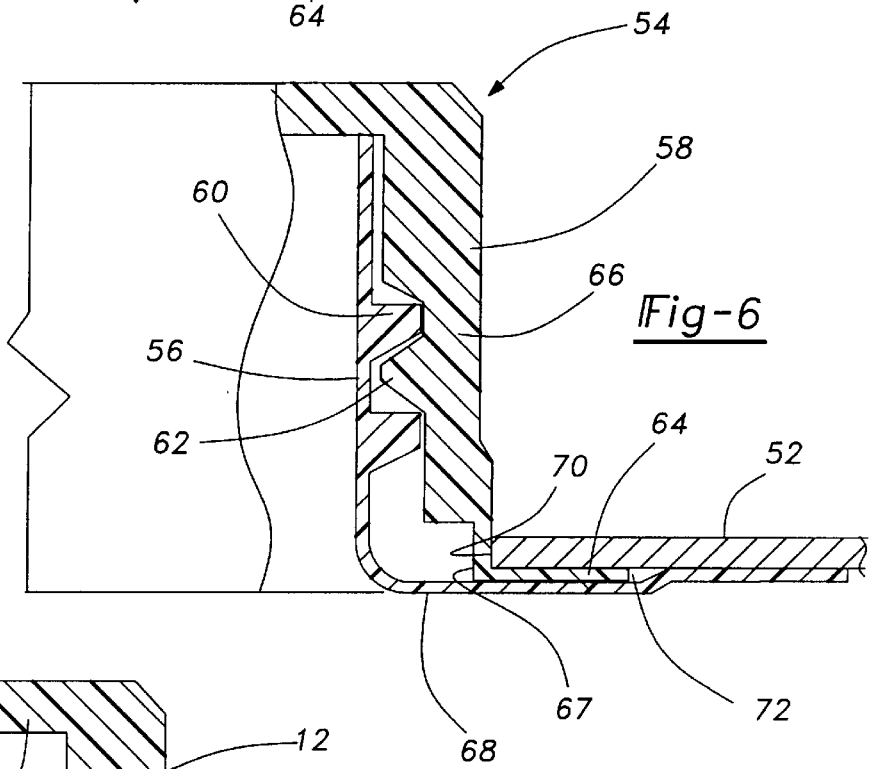
FIG. 6 is an enlarged cross-sectional view of the closure and container seen in FIG. 5; prior to any opening.

Referring now to FIGS. 5 through 6, another embodiment of the invention is disclosed in connection with the upper end of a gable-top, folded container. As best seen in FIGS. 5 and 6, container 50 has a wall 52 which supports a fitment 54 incorporating a spout 56 and a closure 58. The spout 56 and closure 58 are provided with complementary threads 60 and 62 respectively, which engage each other to hold the closure 58 on the spout 56.

The closure 58 is provided with projections or fingers 64 which extend radially from the lower portion of the skirt 66 which forms an annular lip 67 adjacent the open end of the closure 58. If desired, a single flexible, web could be used. In either case, the fingers or webs are very thin and flexible and extending radially outward from the annular lip 67.

The lower end of the nozzle or spout 56 is provided with a radially extending flange 68. With the closure 58 in a closed position on the spout 56, the projections or fingers 64 extend radially of the closure 58 in abutting relationship with the inside wall surface of the wall 52 and the flange 68 is in abutting relationship with the fingers 64. The fitment 54 is positioned in an opening 70 in the wall 52 and the outer periphery of the flange 68 is fused to the inner surface of the wall 52 to form a permanent connection to hold the fitment 54 in sealed relationship to the container 50. In that condition, as best seen in FIG. 6 the flange 68 and the inner surface of the wall 64 form an annular recess 72 for receiving and concealing the fingers or projections 64.

The fitment 54 is applied to the container 50 prior to filling of the container. Filling occurs through the opened gable-top of the container with the fitment 54 in its closed and mounted position in the wall 52. After the container 50 is filled, the top is closed and sealed.

When the closure 58 is removed to open the container 50 for the first time, the fingers or projections 64 slide out of the recess 72 to permit removal of the closure 58 completely from the spout 56, after which the contents of the container 50 can be dispensed. Upon replacement of the closure 58, the projections or fingers 64 are disposed at the exterior portion of the container wall 52, as best seen in FIG. 5. The exterior positioning of the fingers 64 gives a visual indication of prior opening of the container. The replacement of the projections or fingers 64 in their original position, to conceal prior opening is difficult if not impossible because of the necessity of aligning all of the fingers and guiding them into the recess 72. Furthermore the fingers are concealed by permanent components which cannot be removed or altered to defeat the tamper indicating feature.

A tamper indicating closure and container assembly has been provided in which prior opening of the assembly is indicated by exposing projections formed integrally with the closure with such projections remaining concealed in the originally closed position of the assembly. The tamper indicating features are accomplished without breakage or fracture or tear strips. Once opened, the closure resists any effort to replace it in its original position with the tamper indicating features concealed.

I claim:

1. A tamper indicating closure and container assembly comprising:

a container having a wall portion, a fitment including a pouring spout and a closure, said fitment being attached to said wall portion, said pouring spout having an opening at one end and an annular flange at the other end, said pouring spout being mounted on said container with said flange disposed within and attached to said wall portion to form an annular recess therewith, said closure being adapted to close said opening in said pouring spout and having an annular lip adjacent said annular recess when said closure is on said container, a projection extending from said closure adjacent said annular lip of said closure in parallel adjacent relationship to said wall portion of said container and being disposed in said annular recess in the initial closed position of said closure on said container, said projection being removable from said annular recess upon initial opening of said container and resisting repositioning of said projection in said recess upon re-closing of said container to expose said projection at the exterior surface of said container to indicate prior opening.

2. The combination of claim 1 wherein said projection extends radially from said closure.

3. The combination of claim 1 wherein said projection is formed by a plurality of fingers in uniformly spaced relation on said lip.

4. A tamper indicating closure and container assembly comprising:

a container having a body with a wall forming exterior and interior surfaces, said wall having an opening therein, a fitment including a pouring spout forming a pouring opening at one end and a flange at the other end, said spout being disposed in said opening in said wall of said container with said flange permanently attached to said wall and forming a recess with said wall, a closure attachable to said spout for closing said pouring opening and having an annular lip defining an open end of said closure, said annular lip being in close proximity to said wall when said closure is on said fitment, and a projection extending radially from said annular lip of said closure and being disposed in said annular recess to conceal said projection when said closure is on said spout and prior to initial opening of said container, said projection being removable from said recess upon opening of said container and resisting replacement in said recess upon replacement of said closure on said container after initial opening to expose said projection at said exterior surface of said wall to indicate prior opening.

5. The combination of claim 4 wherein said projection is in the form of fingers extending in uniformly spaced relationship from said annular lip of said closure.

6. The combination of claim 4 wherein said fingers extend radially of said annular lip in close proximity of said body portion of said container.

7. The combination of claim 4 wherein said fitment including said pouring spout and attached closure is attachable as a unit to said wall.

8. The combination of claim 4 wherein said flange is disposed within said container on the interior surface of said wall.

9. The combination of claim 4 wherein said projection is concealed by said wall of said container prior to initial opening of said container.

* * * * *